United States Patent [19]

Brown et al.

[11] 4,333,824

[45] Jun. 8, 1982

[54] REFINING HIGHLY AROMATIC LUBE OIL STOCKS

[75] Inventors: William F. Brown, Port Arthur; Albert G. Bieber, China, both of Tex.

[73] Assignee: Texaco Inc., White Plains, N.Y.

[21] Appl. No.: 163,571

[22] Filed: Jun. 27, 1980

[51] Int. Cl.[3] ..... C10G 21/20

[52] U.S. Cl. ..... 208/326

[58] Field of Search ..... 208/326

[56] References Cited

U.S. PATENT DOCUMENTS

| | | | |
|---|---|---|---|
| 2,771,494 | 11/1956 | Weedman | 208/326 |
| 3,299,158 | 1/1967 | Wirth et al. | 208/326 |
| 3,451,925 | 6/1969 | Morris et al. | 208/326 |
| 3,461,066 | 8/1969 | Morris et al. | 208/324 |
| 3,721,620 | 3/1973 | Paret et al. | 208/326 |
| 3,755,154 | 8/1973 | Akabayashi et al. | 208/326 |

*Primary Examiner*—Earl C. Thomas
*Assistant Examiner*—Wayne A. Langel
*Attorney, Agent, or Firm*—Carl G. Ries; Robert A. Kulason; George J. Darsa

[57] ABSTRACT

A process for solvent extraction of higher aromatic hydrocarbon oils with N-methyl-2-pyrrolidone wherein N-methyl-2-pyrrolidone is separated from a solvent-extract mix in a series of distillation steps with recirculation of a portion of a partially stripped extract mix from an intermediate distillation step to the extraction step to improve the solvent-oil ratio in the extraction step and conserve energy as compared with conventional processes in which the solvent power of N-methyl-2-pyrrolidone is moderated by incorporating water in the solvent.

7 Claims, 3 Drawing Figures

REFINING HIGHLY AROMATIC LUBE OIL STOCKS

This invention relates to an improved process for the solvent extraction of a highly aromatic petroleum oil fraction containing aromatic and non-aromatic components. In one of its more specific aspects, the invention relates to a method for solvent extraction of lubricating oil stocks with a highly selective solvent, i.e., N-methyl-2-pyrrolidone, at a low solvent to oil dosage, employing a portion of the extract oil product as a solvent modifier with a resultant savings in energy as compared with solvent refining processes employing N-methyl-2-pyrrolidone with water as the solvent modifier.

It is well known that aromatic and unsaturated components of a lubricating oil base stock, such as those derived from crude petroleum by fractional distillation, may be separated from the more saturated hydrocarbon components by various processes involving solvent extraction of the aromatic and unsaturated hydrocarbons. The removal of aromatics and other undesirable constituents from lubricating oil base stocks improves the viscosity index, color, oxidative stability, thermal stability, and inhibition response of the base oils and the ultimate lubricating oil products. A process which has received widespread commercial acceptance employs N-methyl-2-pyrrolidone as solvent.

The process of the present invention employs N-methyl-2-pyrrolidone modified by the addition of 0.5 to 3 weight percent extract oil as a solvent modifier for solvent extraction of highly aromatic feedstocks, such as those derived from Arabian Light crude oils.

The advantages of N-methyl-2-pyrrolidone over other solvents as a lubricating oil extraction solvent for the removal of undesirably aromatic and polar constituents from lubricating oil base stocks are known in the art. In particular, N-methyl-2-pyrrolidone is chemically stable, has low toxicity, and has the ability to produce refined oils of improved quality as compared with other known solvents.

Processes employing N-methyl-2-pyrrolidone as solvent and illustrating conventional processing operations are disclosed in U.S. Pat. Nos. 3,451,925 and 3,461,066, incorporated herein by reference.

In conventional lubricating oil refining processes employing N-methyl-2-pyrrolidone, the solvent extraction step is carried out under conditions effective to recover about 30 to 90 volume percent of the lubricating oil charge as raffinate or refined oil and to extract about 10 to 70 volume percent of the charge as an aromatic extract. The lubricating oil stock is contacted with the solvent, N-methyl-2-pyrrolidone, at a temperature at least 10° C., preferably at least 50° C., below the temperature of complete miscibility of the lubricating oil stock in the solvent.

In the extraction step, operating conditions are selected to produce a primary raffinate having a dewaxed viscosity index of about 75 to 100, and preferably about 85 to 96. Solvent extraction temperatures are generally within the range of 43° to 100° C. (110° to 212° F.), preferably within the range of 54° to 95° C. (130° to 205° F.), with solvent dosages within the range of 50 to 500 volume percent, and preferably within the range of 100 to 300 volume percent.

To produce a finished lubricating oil base stock, the primary raffinate is dewaxed to the desired pour point. If desired, the refined or dewaxed oil may be subjected to a finishing treatment for color and stability improvement, for example, mild hydrogenation.

The present invention provides an improvement in the solvent refining of lubricating oil stocks with N-methyl-2-pyrrolidone extraction processes wherein the solvent power of the N-methyl-2-pyrrolidone is modified without the need for water as a moderator. This is accomplished by returning part of the extract, to the extraction step. The recycle extract is separated from the primary extract mix and returned to the extraction zone admixture with substantially dry N-methyl-2-pyrrolidone solvent. In one embodiment of this invention, extract may be recycled to the extraction zone to displace non-aromatic hydrocarbons from the extract phase in known manner. The solvent recycled to the extraction zone may be further modified by adding a portion of the raffinate to the mixture of recycled solvent and extract.

FIG. 1 of the drawings is a schematic flow diagram illustrating a solvent refining process embodying the improved process of this invention.

Figure 1:
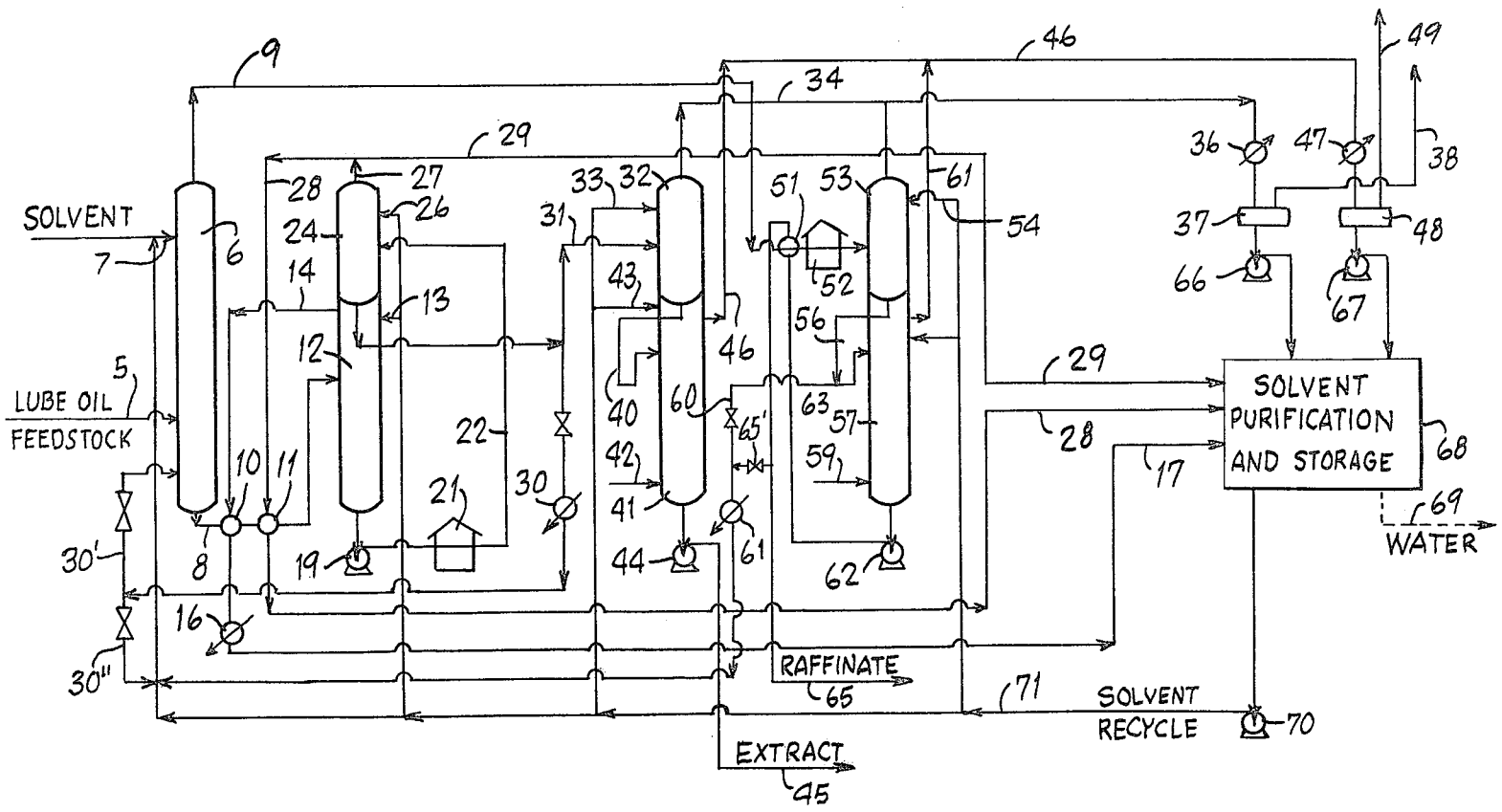

With reference to FIG. 1 of the drawing, a preferred embodiment of the subject invention is disclosed as applied to solvent refining highly aromatic lubricating oil feedstocks.

Lubricating oil feedstock enters the system through line 5 and is introduced into extraction tower 6 where it is brought into intimate countercurrent contact with N-methyl-2-pyrrolidone introduced into the upper portion of the extraction tower through line 7.

Extraction tower 6 typically operates at a pressure in the range of 550 to 1000 kPa (80 to 145 psia). An extract mixture typically comprising about 85 percent solvent is withdrawn from the bottom of extraction tower 6 through line 8. A raffinate mixture, comprising typically 85 percent hydrocarbon oil admixed with solvent is discharged from the extraction tower 6 through line 8 and processed for the recovery of raffinate from the solvent as described hereinafter.

The major portion of the solvent appears in the extract mixture withdrawn from the bottom of extraction tower 6 through line 8. The extract mixture is processed first for the recovery of solvent from the extract and then for recovery of the extract as a marketable product of the process. The extract mixture, typically containing about 85 percent of the solvent, is passed through line 8 and heat exchangers 10 and 11 which serve to preheat the extract mixture, and introduced into the upper part of a low pressure flash tower 12. Flash tower 12 typically operates at a pressure 108 to 136 kPa (1 to 5 psig). Solvent is introduced into the upper part of tower 12 as reflux through line 13. Solvent separated from the extract in flash tower 12 is discharged through line 14 to heat exchanger 10 wherein it is cooled by indirect heat exchange with the extract mixture from extraction tower 6 thereby preheating the extract mixture prior to introduction to flash tower 12 and condensing solvent vapors. The solvent is further cooled and condensed in a cooler 16 and passed through line 17 to solvent purification and storage system 68 described in more detail hereinafter.

The unvaporized portion of the extract mixture is withdrawn from the bottom of flash tower 12 by pump 19 and passed through a heater 21 wherein it is heated to an elevated temperature, and introduced through line 22 to a high pressure flash tower 24. The high pressure flash tower 24 suitably is maintained at a pressure within the range of 375 to 415 kPa (40 to 45 psig) and is provided with a reflux of solvent which enters the upper part of tower 24 through line 26.

A further amount of solvent is separated from the extract in tower 24, the solvent rich vapors leaving the top of the tower through line 27. Part of the vapors from line 27 are passed through line 28 to heat exchanger 11 for indirect heat exchange with extract mixture from the lower part of extraction tower 6, serving to condense the solvent vapors and preheat the extract mixture prior to its introduction to column 12. Following the heat exchange, the condensed solvent is passed through line 28 to solvent purification and storage as described hereinafter. The remainder to the solvent vapors passing overhead from high pressure separator 24 pass through line 29 to the solvent purification and storage system.

The hydrocarbon oil extract, still containing some solvent, for example, a mixture of 85 volume percent hydrocarbon oil and 15 volume percent solvent, is withdrawn from the lower portion of high pressure flash tower 24. A portion of the extract mixture from flash tower 24 may be passed through cooler 30 and line 30' to the lower part of extraction tower 6. Alternatively, or simultaneously, a portion of the extract mixture from flash tower 24 may be passed through cooler 30 and line 30'' to line 71 and introduced into extraction tower 6 in admixture with recycle solvent. The remainder passes through line 31 to vacuum flash tower 32. Vacuum flash tower 32 typically is a countercurrent vapor-liquid contact device suitably provided with a cascade or bubble trays. Dry solvent is introduced near the top of the tower 32 through line 33 as reflux. In the vacuum flash tower 32, additional separation of extract from solvent takes place. Solvent vapors are withdrawn from the upper portion of flash tower 32 through line 34 to a condenser 36 and solvent accumulator 37. Uncondensed gases are withdrawn from accumulator 37 through line 38.

An extract rich fraction is withdrawn from the lower part of vacuum flash tower 32 through line 40 and introduced into the upper portion of stripper 41. Stripper 41 is typically a countercurrent vapor-liquid contact column provided with bubble trays in which the liquid extract flowing downwardly through the tower is contacted with inert stripping gas or steam introduced into the lower portion of the stripper 41 through line 42. Solvent is introduced near the top of stripping column 41 through line 43 as reflux. Extract oil containing less than about 50 parts per million solvent and typically comprising 80 percent unsaturated hydrocarbons and about 20 percent saturated hydrocarbons is withdrawn from the lower part of stripper 41 by pump 44 and discharged through line 45 as a product of the process.

Solvent vapors mixed with stripping medium, i.e., inert gas or steam, and usually containing also some light oil carried over from the flash tower and stipper, are discharged from the upper part of the stripper 41 through line 46 to condenser 47 and solvent accumulator 48. Condensate is separated from uncondensible gases in solvent accumulator 48, and the gases are withdrawn from accumulator 48 through line 49 to a vacuum system not illustrated in the drawing.

The raffinate mixture leaving the top of the extraction column 6 through line 9 is passed through a heat exchanger 51 and heater 52 wherein the raffinate mixture is heated, and then introduced into a vacuum flash tower 53, similar to vacuum flash tower 32, previously described. Vacuum flash tower 53 is provided with a means for the introduction of solvent through line 54 to the upper portion of the tower as reflux. Solvent vapors are taken overhead from flash tower 53 to line 34 for recovery together with solvent from flash tower 32.

The unvaporized portion of the raffinate mixture is withdrawn from the bottom of vacuum flash tower 54 through line 56 and introduced into the upper portion of a stripping column 57 similar to stripping column 41, previously described. Solvent is introduced into stripper 57 as a reflux through line 58 and a stripping medium, e.g., inert gas or steam, is introduced near the bottom of the stripper through line 59. Stripping medium and solvent vapors are discharged from stripper 57 through lines 61 and 46 to condenser 47 for recovery together with the stripping medium and solvent from stripper 41.

A portion of the raffinate mixture from the bottom of vacuum flash tower 54 may be passed through line 60 and cooler 60' to line 71 and introduced into extraction tower 6 in admixture with recycle solvent.

The bottoms product from stripper 57, substantially completely freed from solvent, is passed by a pump 62 through line 63 to heat exchanger 51 where it is cooled by indirect heat exchange with the incoming feed to the vacuum flash tower 53 and is discharged through line 65 as solvent refined lubricating oil base stock, the principal product of the process. If desired, product raffinate may be passed through line 65' to cooler 61' for recycle to extraction tower 6 with recycle solvent from line 71.

Condensate from accumulator drums 37 and 48 are passed by pumps 66 and 67, respectively, to a solvent purification and storage system 68. Various process steps may be utilized in the purification of solvent for reuse in the process, including, for example, distillation, gas stripping, and the like, primarily for removal of water, if present, and for removal of polymers, oils, and other undesirable constituents. Condensate water from stripping or excess water from an extraneous source may be removed from the solvent in the solvent purification system 68 and discharged through line 69. Solvent is recycled to the process by pump 70 through line 71 to lines 7, 13, 26, 33, 43, 54 and 58 as required.

In a preferred embodiment of the process of this invention, partially stripped extract from high pressure flash tower 24 is recirculated to extraction tower 6 via line 30'' in an amount sufficient to provide from 0.5 to 3 weight percent, preferably from 1 to 2 weight percent extract reckoned on a solvent-free basis in the recycled solvent to the extraction tower.

The following examples illustrate preferred embodiments of the process of this invention.

EXAMPLE 1

A number of runs were carried out to determine the effect of adding extract oil to N-methyl-2-pyrrolidone as solvent in the refining of lubricating oil base stocks. The test runs were carried out in a twelve-stage countercurrent contactor with the feed entering stage six and the solvent entering stage twelve.

Extract is withdrawn at stage one and raffinate, at stage twelve. The raffinate product was then dewaxed and tested for viscosity index and ASTM pour point.

In Runs 1 to 16, inclusive, runs were conducted with a Wax Distillate-5 (WD-5) as the hydrocarbon feed. In Runs 5 to 16 various amounts of the extract from the respective runs, ranging from 0.5 weight percent to 2 weight percent, were added to the N-methyl-2-pyrrolidone solvent supplied to the extraction zone. Operating conditions and results are shown in Table I.

TABLE I

Solvent Refining-Wax Distillate-5 (WD-5)

| Run No. | 1 | 2 | 3 | 4 | 5 | 6 | 7 | 8 |
|---|---|---|---|---|---|---|---|---|
| Solvent | N-methyl-2-pyrrolidone (MP) 0.1 wt. % water | | | | MP + 0.5 wt. % WD-5 Extract 0.2 wt. % water | | | |
| Dosage (1) | 97 | 155 | 196 | 247 | 114 | 152 | 197 | 246 |
| Yield, Vol. % | 48.7 | 42.9 | 41.3 | 37.3 | 45.0 | 41.5 | 40.5 | 36.7 |
| $RI_{70}$ (2) | 1.4513 | 1.4474 | 1.4460 | 1.4448 | 1.4496 | 1.4470 | 1.4460 | 1.4441 |
| Temp., °F. | | | | | | | | |
| Raffinate Out | 150 | 150 | 150 | 150 | 150 | 150 | 150 | 154 |
| Extract Out | 130 | 130 | 130 | 131 | 130 | 131 | 130 | 130 |
| Dewaxed Oil | | | | | | | | |
| Vis. Index | 91 | 97 | 100 | 104 | 93 | 98 | 101 | 104 |
| Pour, °F. | −5 | −10 | −5 | 0 | −5 | −5 | −5 | −5 |
| Run No. | 9 | 10 | 11 | 12 | 13 | 14 | 15 | 16 |
| Solvent | MP + 1 wt. % WD-5 Extract 0.1 wt. % water | | | | MP + 2 wt. % WD-5 Extract 0.2 wt. % water | | | |
| Dosage (1) | 103 | 145 | 200 | 240 | 123 | 150 | 208 | 252 |
| Yield, Vol. % | 50.9 | 49.2 | 42.3 | 40.2 | 51.5 | 48.5 | 44.8 | 41.8 |
| $RI_{70}$ (2) | 1.4517 | 1.4493 | 1.4464 | 1.4451 | 1.4515 | 1.4495 | 1.4481 | 1.4462 |
| Temp., °F. | | | | | | | | |
| Raffinate Out | 149 | 150 | 150 | 150 | 150 | 150 | 150 | 150 |
| Extract Out | 128 | 129 | 130 | 133 | 130 | 130 | 131 | 130 |
| Dewaxed Oil | | | | | | | | |
| Vis. Index | 90 | 95 | 99 | 102 | 89 | 93.5 | 96 | 100 |
| Pour, °F. | −5 | 0 | −15 | −10 | −5 | −5 | −5 | 0 |

(1) Volume percent based on volume of charge oil
(2) Refractive index at 70° C. of product raffinate A comparison of Runs 5 to 8 with Runs 1 to 4 of Table I indicates that the addition of 0.5 weight percent extract from a light paraffinic wax distillate feedstock, Wax Distillate 5, to the N-methyl-2-pyrrolidone solvent results in a decrease in product yield with little significant increase in product quality. In contrast, a comparison of runs 9 to 16 with runs 1 to 8 indicates that significant improvements in product yield may be obtained when the extract content of the N-methyl-2-pyrrolidone solvent supplied to the extraction zone is increased to one and two weight percent.

With this particular feedstock, significant increases in yield are obtained when the solvent composition comprises 1 to 2 weight percent extract from the feedstock undergoing solvent refining, with some reduction in product quality as indicated by the refractive index at 70° C. ($RI_{70}$) of the raffinate and the viscosity index of the dewaxed oil.

EXAMPLE 2

In a second series of runs, a Wax Distillate-20 (WD-20) lubricating oil base stock was treated with substantially pure (99.7 percent) N-methyl-2-pyrrolidone substantially free from water (0.1 weight percent water), and with mixtures of N-methyl-2-pyrrolidone and WD-20 extract from the respective runs.

In Runs 20 to 22, 1.0 weight percent WD-20 extract was added to the N-methyl-2-pyrrolidone solvent supplied to the extraction zone whereas in Runs 23 to 25, 2.0 weight percent WD-20 extract was added to the solvent. Operating conditions and results are shown in Table II.

TABLE II

Solvent Refining Wax Distillate-20 (WD-20)

| Run No. | 17 | 18 | 19 | 20 | 21 | 22 |
|---|---|---|---|---|---|---|
| Solvent | N-methyl-2-pyrrolidone (MP) 0.1 wt. % water | | | MP + 1.0 wt. % WD-20 Extract 0.2 wt. % water | | |
| Dosage (1) | 100 | 170 | 315 | 174 | 248 | 315 |
| Yield, Vol. % | 65.4 | 59.7 | 49.5 | 60.6 | 56.9 | 54.8 |
| $RI_{70}$ (2) | 1.4636 | 1.4604 | 1.4564 | 1.4606 | 1.4585 | 1.4575 |
| Temp., °F. | | | | | | |
| Raffinate Out | 160 | 162 | 165 | 159 | 160 | 159 |
| Extract Out | 129 | 129 | 132 | 130 | 131 | 130 |
| Dewaxed Oil | | | | | | |
| Vis. Index | 93 | 97 | 103 | 97 | 99 | 101.5 |
| Pour, °F. | +10 | +10 | +10 | +10 | +10 | +10 |

| Run No. | 23 | 24 | 25 |
|---|---|---|---|
| Solvent | MP + 2.0 wt. % WD-20 Extract 0.2 wt. % water | | |
| Dosage | 100 | 248 | 314 |
| Yield, Vol. % | 64.5 | 58.4 | 54.4 |
| $RI_{70}$ | 1.4644 | 1.4594 | 1.4585 |
| Temp., °F. | | | |
| Raffinate Out | 159 | 160 | 159 |
| Extract Out | 130 | 130 | 129 |
| Dewaxed Oil | | | |
| Vis. Index | 92 | 97.5 | 100 |
| Pour, °F. | +10 | +10 | +10 |

(1) Volume percent based on volume of charge oil
(2) Refractive index at 70° C. of product raffinate A comparison of the results of the runs reported in Table II indicates that the addition of small amounts of extract to the solvent feed stream significantly increases the yield of refined raffinate product with only a slight decrease in product quality as indicated by the refractive index of the raffinate product and by the viscosity index of the resulting dewaxed oil.

EXAMPLE 3

In a third series of runs, a Wax Distillate-50 (WD-50) lubricating oil base stock was treated with substantially pure dry N-methyl-2-pyrrolidone and with mixtures of N-methyl-2-pyrrolidone solvent and WD-50 extract. The operating conditions and results are shown in Table III.

TABLE III

| | Solvent Refining Wax Distillate-50 (WD-50) | | | | | | | | | | |
|---|---|---|---|---|---|---|---|---|---|---|---|
| Run No. | 26 | 27 | 28 | 29 | 30 | 31 | 32 | 33 | 34 | 35 | 36 |
| Solvent | N-methyl-2-pyrrolidone (MP) 0.1 wt. % water | | | | MP + 1.0 wt. % WD-50 Extract 0.1 wt. % water | | | MP + 2.0 wt. % WD-50 Extract 0.1 wt. % water | | | |
| Dosage (1) | 97 | 135 | 200 | 239 | 102 | 157 | 190 | 92 | 137 | 200 | 232 |
| Yield, Vol. % | 53.8 | 54.0 | 52.3 | 47.1 | 57.5 | 55.6 | 49.8 | 64.7 | 60.1 | 57.9 | 54.7 |
| $RI_{70}$ (2) | 1.4716 | 1.4681 | 1.4660 | 1.4645 | 1.4705 | 1.4693 | 1.4669 | 1.4733 | 1.4710 | 1.4694 | 1.4680 |
| Temp., °F. | | | | | | | | | | | |
| Raffinate Out | 210 | 210 | 210 | 210 | 211 | 212 | 210 | 209 | 209 | 210 | 210 |
| Extract Out | 180 | 180 | 180 | 180 | 183 | 180 | 181 | 180 | 182 | 181 | 181 |
| Dewaxed Oil | | | | | | | | | | | |
| Vis. Index | 86 | 91 | 94 | 96 | 87.5 | 91.5 | 93.5 | 83.5 | 86 | 90 | 91 |
| Pour, °F. | +10 | +15 | +15 | +15 | +15 | +15 | +15 | +15 | +15 | +15 | +15 |

Figure 3:
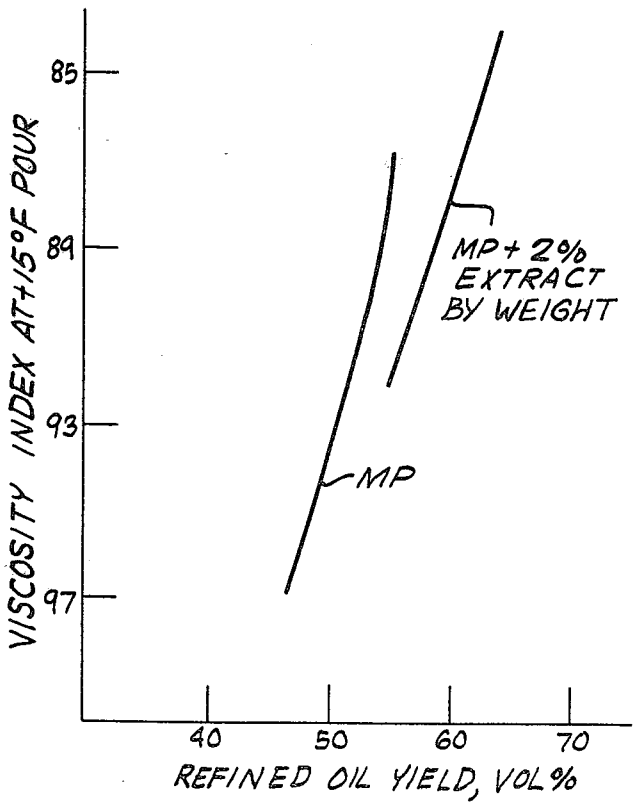
FIG. 3 is a similar graphic illustration showing the relationship between viscosity index of the refined oil and refined oil yield for the solvent systems of FIG. 2.
Figure 2:
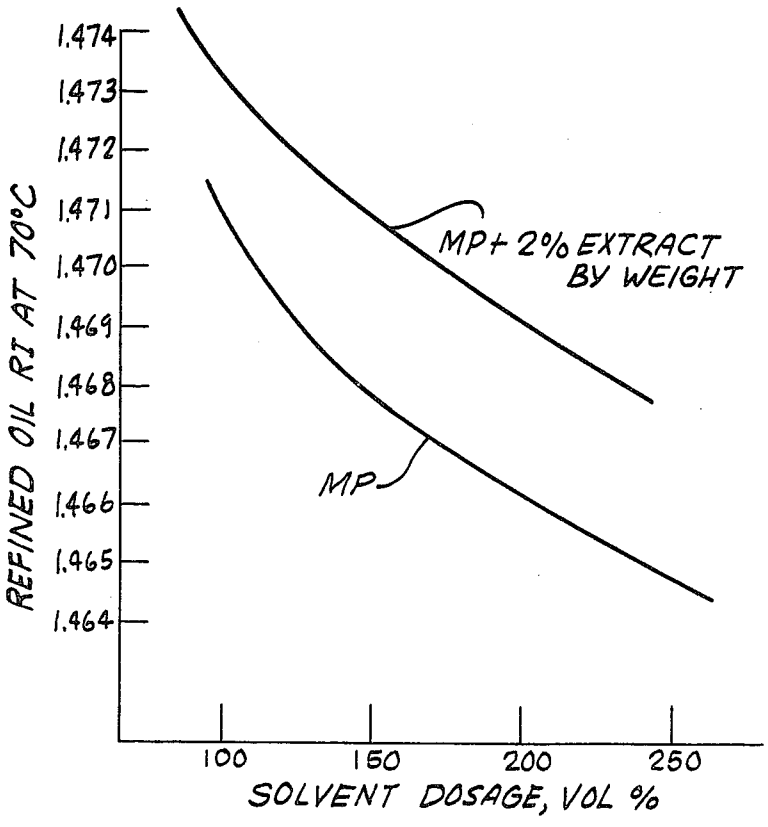
FIG. 2 is a graphic illustration of the relationship between solvent dosage and refined oil quality as represented by its refractive index for dry N-methyl-2-pyrrolidone (MP) and for N-methyl-2-pyrrolidone modified by the addition of extract.

(1) Volume percent based on volume of charge oil
(2) Refractive index at 70° C. of product raffinate A comparison of the results of the runs reported in Table III indicates that addition one to two weight percent extract from the feedstock to the solvent feed stream and an increase in solvent dosage significantly increased the yield of refined oil product. The data from Runs 26 to 29 and 33 to 36 are illustrated graphically in FIGS. 2 and 3.

It is evident that the process of this invention provides a means for increasing the yield of refined oil product from highly aromatic feedstocks at relatively low to moderate solvent-to-oil dosages without the need for water as a solvent moderator.

We claim:

1. In a process for solvent refining a petroleum based oil stock containing aromatic and non-aromatic components wherein said oil stock is contacted with N-methyl-2-pyrrolidone in a solvent extraction zone to produce an aromatics-rich primary extract phase containing solvent and an aromatics poor raffinate phase containing solvent, said phases are separated from one another and separately processed for the recovery of solvent therefrom for recycle to the process, the improvement which comprises returning a portion of said aromatics-rich extract to said solvent extraction zone in admixture with said recycle solvent.

2. A process according to claim 1 wherein said aromatics-rich extract returned to said extraction zone in admixture with recycle solvent comprises N-methyl-2-pyrrolidone in an amount less than that contained in said primary extract phase.

3. A process according to claim 1 wherein the volume of extract returned to said solvent extraction zone is sufficient to provide 0.5 to 3 weight percent extract reckoned on a solvent-free basis in admixture with N-methyl-2-pyrrolidone supplied to said solvent extraction zone.

4. A process according to claim 3 wherein the volume of extract returned to said solvent extraction zone is sufficient to provide 1 to 2 weight percent extract in admixture with said N-methyl-2-pyrrolidone supplied to said solvent extraction zone.

5. A process according to claim 1 in which the contacting temperature in said solvent extraction zone is within the range of 50° to 80° C.

6. A process according to claim 1 in which solvent is separated from said extract phase in a series of distillation steps and said aromatics rich extract returned to said extraction zone is a fraction withdrawn from an intermediate step in said series and comprises N-methyl-2-pyrrolidone.

7. In a process for solvent extraction of a hydrocarbon lubricating oil feedstock effecting separation of said hydrocarbon feedstock into a raffinate product of reduced aromaticity and an extract product of increased aromaticity which comprises (a) contacting said hydrocarbon mixture with N-methyl-2-pyrrolidone as solvent for aromatic hydrocarbons in an extraction zone forming a raffinate phase comprising said raffinate product with a minor portion of said solvent dissolved therein and a primary extract phase comprising said solvent with said extract product dissolved therein, (b) passing said primary extract phase to a first distillation zone at a pressure in the range of 1 to 5 psig effecting separation of a portion of said solvent as distillate from distillation bottoms comprising said extract, and (c) heating said bottoms from said first distillation zone and passing said heated bottoms to a second distillation zone maintained at a pressure in the range of 40 to 50 psig wherein an additional portion of said solvent is separated as a distillate from distillation bottoms comprising said extract and at least one third of said portion of said solvent, the improvement which comprises (d) admixing a portion of said second distillation bottoms with N-methyl-2-pyrrolidone solvent supplied to said extraction zone in an amount sufficient to form a solvent feed stream containing 0.5 to 3 weight percent of said extract calculated on a solvent-free basis.

* * * * *